US005102529A

United States Patent [19]

Hickin

[11] Patent Number: 5,102,529

[45] Date of Patent: Apr. 7, 1992

[54] COMBINATION GOLF CLUB AND BALL CARRYING CASE

[76] Inventor: Ray Hickin, 43046 Old Orchard Road, Sardis, Canada, V2R 1A9

[21] Appl. No.: 656,598

[22] Filed: Feb. 19, 1991

[51] Int. Cl.[5] ..... A63B 55/00; A63B 55/04; A63B 55/06

[52] U.S. Cl. ..... 206/315.3; 206/315.3; 206/315.6; 206/315.7

[58] Field of Search ..... 206/315.2–315.9

[56] References Cited

U.S. PATENT DOCUMENTS

| | | | |
|---|---|---|---|
| 1,696,062 | 12/1928 | Thurlow et al. | 206/315.2 |
| 1,849,803 | 3/1932 | Pedersen | 206/315.7 X |
| 2,879,819 | 3/1959 | Turnbull | 206/315.4 |
| 2,938,559 | 5/1960 | Harkrader | 206/315.2 |
| 2,970,629 | 2/1961 | Masten | 206/315.2 |
| 3,101,108 | 8/1963 | Ingoldt | 206/315.2 |
| 3,866,646 | 2/1975 | Nevard | 206/315.2 X |
| 4,317,477 | 3/1982 | Baptista | 206/315.2 X |
| 4,449,310 | 5/1984 | Kline | 206/315.3 X |
| 4,784,305 | 11/1988 | Schoenberg | 206/315.1 X |
| 4,915,221 | 4/1990 | Spangler | 206/315.3 |

FOREIGN PATENT DOCUMENTS

| | | | |
|---|---|---|---|
| 573899 | 4/1959 | Canada | 206/315.4 |

*Primary Examiner*—William I. Price
*Attorney, Agent, or Firm*—Francis X. LoJacono

[57] ABSTRACT

A combination golf club and golf ball carrying case adapted to carry a given number of golf clubs within an elongated rigid housing that defines the carrying case. The upper end of the housing is closed by a cover cap adapted to receive and support a plurality of tube members within the enlarged compartment defined by the housing, the cover cap and a base cap. Each tube member is arranged so as to receive a golf club therein in an upright position and to separate it from the others. Affixed to the housing wall is a golf-ball holding device which allows a number of golf balls to be readily available during the game. The cover cap is formed having a plurality of holes therein to receive the golf-club support tubes, and is also formed having a plurality of extended ear members in which golf tees are supported therein. The base cap is provided with a spike member whereby the carrying case can be supported in an upright position when the spike is inserted into the turf.

4 Claims, 2 Drawing Sheets

FIG. 1
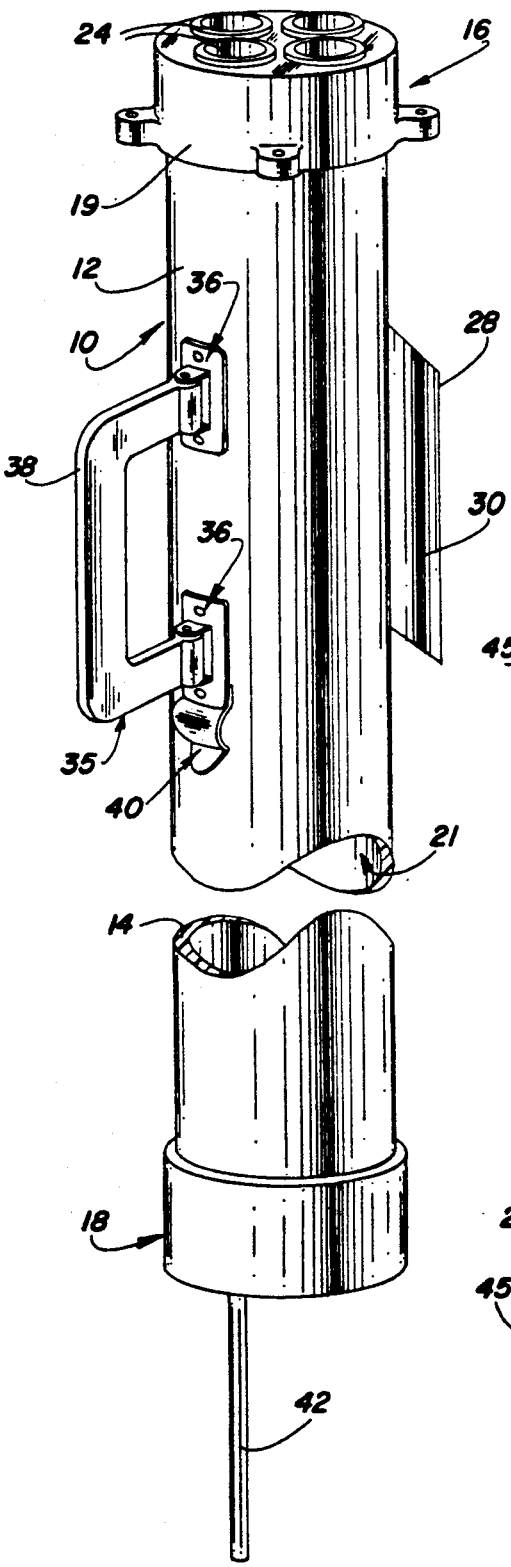
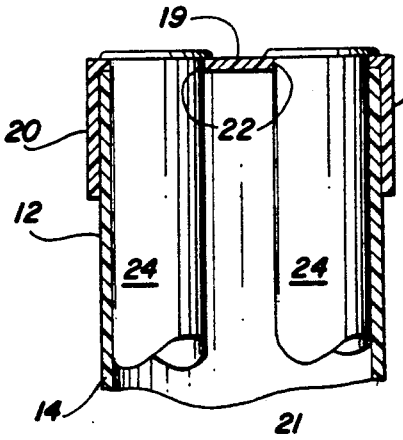
FIG. 5
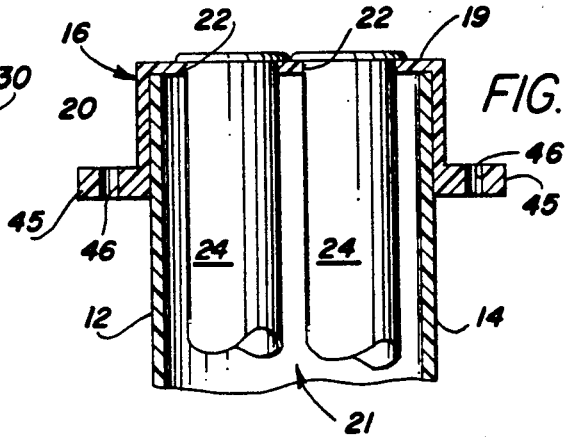
FIG. 6
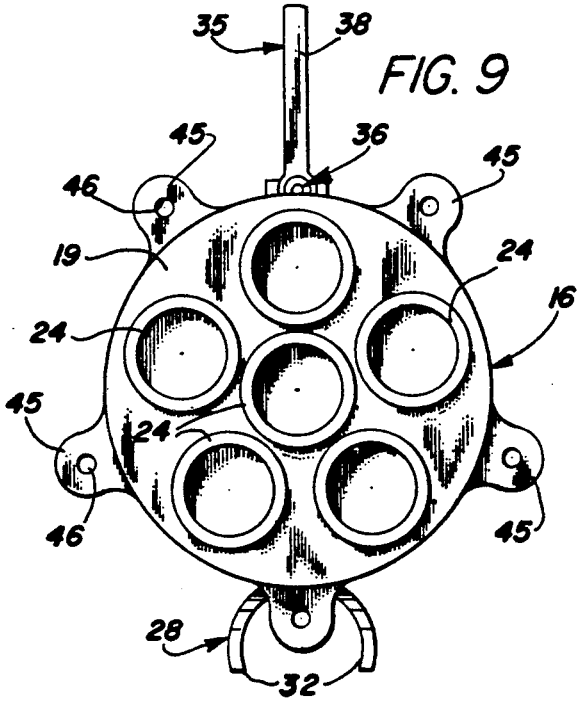
FIG. 9

FIG. 2
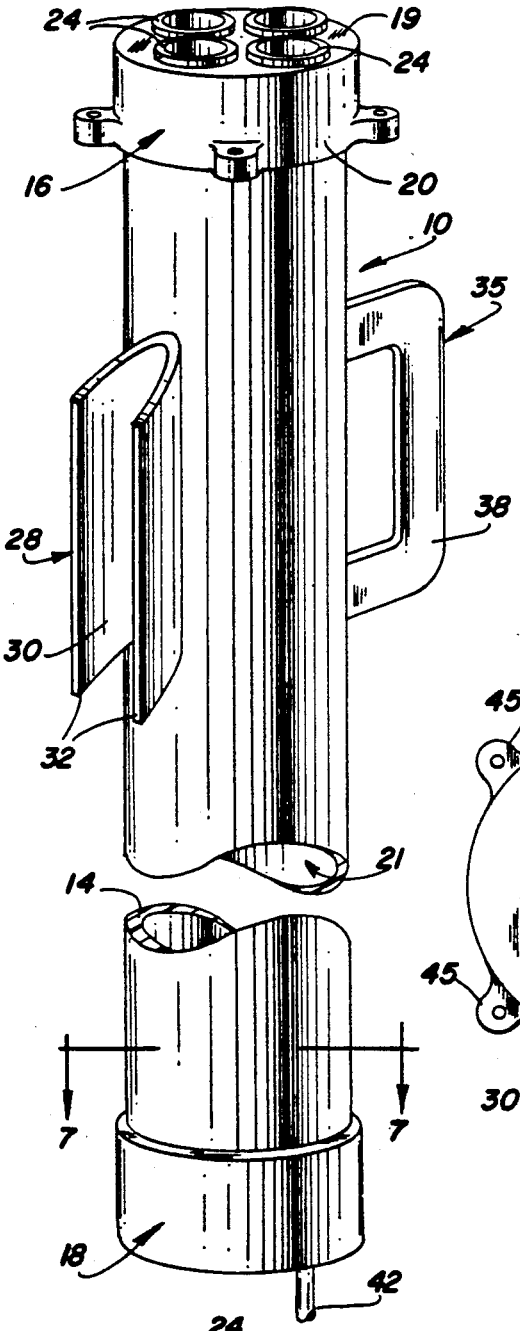
FIG. 3
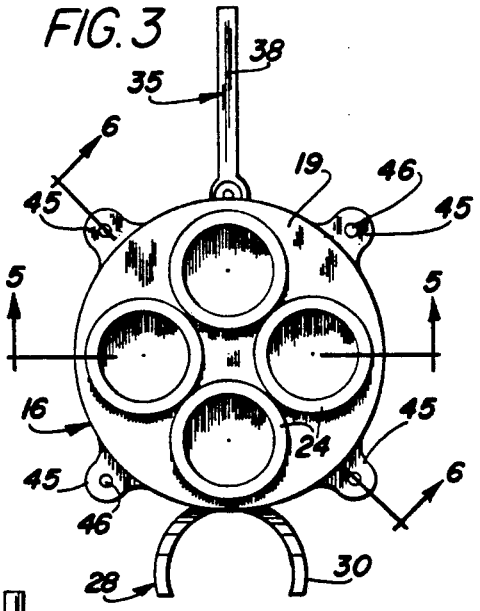
FIG. 4
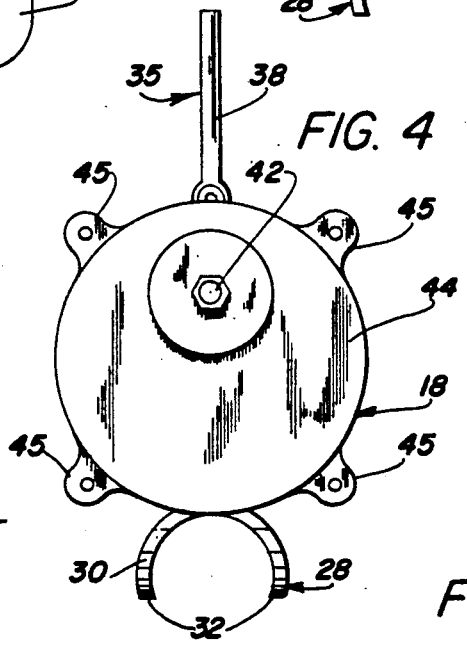
FIG. 7
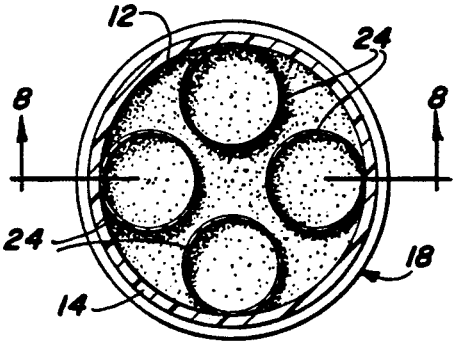
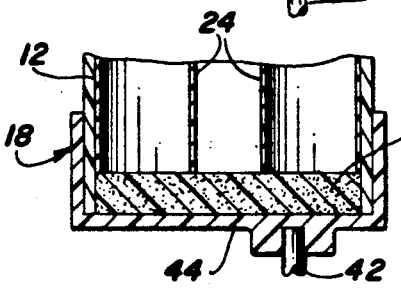
FIG. 8

COMBINATION GOLF CLUB AND BALL CARRYING CASE

BACKGROUND OF THE INVENTION

1. Field of the Invention

The present invention relates to golf bags and the like, and more particularly to a combination golf club and ball carrying case, wherein the carrying case comprises a rigid housing having a fixed cover cap adapted to receive and support a plurality of tube members which hang within the case, each tube member being arranged to receive an individual golf club therein.

2. Description of the Prior Art

As is well known in the art, there are golf bags of various configurations. The majority of such golf bags are designed to carry a full compliment of clubs including three or four woods and eight or more irons. However, such golf bags as this are oftentimes not needed. They become heavy and clumsy to use, particularly when one plays a course that is a short three-par type or the well known pitch-and-putt courses or when a golfer wants to practice on a driving range with only a few selective clubs he or she might be having problems with. Accordingly, there is felt to be a need for a very lightweight golf case that can carry only the essential clubs one would use, whether it be for playing a full course or only a driving range.

SUMMARY AND OBJECTS OF THE INVENTION

The present invention comprises a novel carrying case that is formed to carry a selective number of golf clubs, rather than a full set of clubs. The typical golf-bag arrangement has been redesigned so as to be defined by an elongated case formed from a rigid tubular housing having a cap or cover member adapted to support a plurality of individual golf-club support tubes. It is contemplated that at least three embodiments of the golf-club case can be provided, wherein one embodiment will be formed to support four club-support tubes, a second embodiment will be provided with five support tubes, and a third will be arranged to include six club support tubes. Thus, it can be understood that other arrangements thereof may be designed to include any selective number of golf-club tubes in a particular carrying case. The bottom of the case is closed by a base cap member adapted to have a ground spike affixedly secured thereto, whereby the carrying case can be supported on its own when the spike is forced into the ground. The cover member includes several projecting ear members which are adapted to have golf tees mounted therein. A ball-holding device is also mounted on the annular wall of the case housing along with a handle.

Thus, the present invention has for an important object a provision wherein a golf-club carrying case is formed to receive and store therein a select number of golf clubs when the use of the clubs by a player does not require the need for a full compliment of clubs, such as when playing a pitch-and-putt course, a par-three golf course or when practicing at a driving range.

Still another object of the invention is to provide a combination golf club and ball carrying case that is simple in construction and light weight even when the case includes several golf clubs and balls.

It is still another object of the invention to provide a combination golf club and ball carrying case that allows on to carry a given number of select clubs when practicing at a driving range or when playing a course that does not require a full compliment of golf clubs. The design of the present invention defines a novel lightweight unit that is particularly useful when a golf cart is not used or needed, and thus can be readily used when playing a full eighteen-hole course as well as a three-par course.

Another object of the invention is to provide a golf-club carrying case of this character that is relatively inexpensive to manufacture, and is simple yet rugged in construction.

The foregoing is a description of several preferred embodiments of the invention which are given here by way of example only. The invention is not to be taken as limited to any of the specific features as described, but comprehends all such variations thereof as come within the scope of the appended claims.

BRIEF DESCRIPTION OF THE DRAWINGS

With the above and related objects in view, the invention consists in the details of construction and combination of parts, as will be more fully understood from the following description, when read in conjuction with the accompanying drawings and numbered parts, in which:

FIG. 1 is a front perspective view of a combination golf club and ball carrying case;

FIG. 2 is a rear perspective view of the present invention;

FIG. 3 is a top plan view of the carrying case;

FIG. 4 is a bottom plan view thereof;

FIG. 5 is a cross-sectional view taken substantially along line 5—5 of FIG. 3, illustrating the upper portion of the case and showing the mounted golf-club support tubes;

FIG. 6 is a cross-sectional view taken substantially along line 6—6 of FIG. 3 thereof showing the golf-ball-tee support members formed as part of the cover member of the carrying case;

FIG. 7 is a cross-sectional view taken substantially along line 7—7 of FIG. 2 thereof;

FIG. 8 is a cross-sectional view of the bottom portion of the carrying case taken substantially along line 8—8 of FIG. 7 thereof; and FIG. 9 is a top plan view of an alternative embodiment of the present invention that accomodates at least six golf clubs therein.

DETAILED DESCRIPTION OF THE INVENTION

Referring more particularly to FIGS. 1 and 2, there is shown a combination golf club and ball carrying case, generally indicated at 10. Carrying case 10 comprises an elongated tubular housing 12 defined by annular wall 14. Housing 12 is closed at the top portion thereof by a cover cap member, designated at 16. The bottom portion of housing 12 is closed off by a base cap designated at 18. Both the cover cap 16 and the base cap 18 are fixedly secured to the housing by a suitable means. When the housing and its associated parts are formed from a suitable plastic, they are permanently bonded together by ABS cement.

Cover cap member 16 is formed by a surface wall 19 and depending annular wall 20 is secured over the upper opening of housing 12, thereby defining a large inner compartment 21. Cover cap 16 includes a plurality of juxtaposed openings or holes 22 which are aranged to receive and support an elongated tube member 24. (See FIGS. 5 and 6.) The upper end of tube 24 is formed with an annular lip member adapted to rest on surface wall 19 of cover cap 16 with the tube projecting downwardly to the bottom area of compartment 21 of the housing. The length of the tube 24 is preferably made to extend downwardly to contact a protective pad or cushion member 26, as illustrated in the cross-sectional view of FIG. 8 Thus, when the handle end of a golf club is inserted in tube 24 it will rest on the pad member 26. Cover cap 16 is further formed with a pluality of projecting ear members which provide a means for mounting golf-ball tees (not shown). Each ear member includes a hole therein in which the golf tee is secured until needed.

It is further illustrated in FIGS. 1 and 2 that carrying case 10 includes a means for removably holding golf balls, said holding means being generally indicated at 28. Holding means 28 is defined by resilient clamp member 30 formed having a substantially C-shaped configuration, with the extended side members 32 converging so as to provide a grasping action around the balls positioned therebetween. However, a stored ball can be readily removed therefrom by sliding the ball out of one end thereof. It is contemplated that the clamp member will be formed of suitable plastic and be welded to wall 14 by suitable cement, as previously mentioned above.

Affixed to wall 14 and positioned on the opposite side of holding means 20 is a handle means, designated at 35, which is hingedly attached to housing wall 14, which is more clearly illustrated in FIG. 1. Hinge members 36 are connected to a handle 38 and are secured to wall 14 by any suitable means, such as by being riveted or cemented thereto. In FIG. 1 there is also shown a score-card clip member 40. Score-card clip is shown for illustrative purposes as being secured under the lower hinge member 36, but it should be noted that other types of clips can be used and may be positioned at any suitable location on the carrying case.

Since the carrying case is small, light in weight and easy to carry, there is further provided a means for supporting the carrying case in an upright position when it is not being carried. The case support means is defined by a spike 42 which is embedded in the bottom wall 44 of base cap 18, as seen in FIG. 8. Bottom wall 44 is provided with an enlarged boss member in which the fixed end of spike 42 is secured. Thus, by placing a downward force on case 10 spike 40 is readily forced into the ground surface or turf, whereby the carrying case and the clubs therein are held in a secure upright position.

Referring again to cover cap 16, there is formed thereon a plurality of projecting ear members 45, each having a hole 46 positioned therethrough so as to removably mount a golf-ball tee therein.

It may thus be seen that the objects of the present invention set forth herein, as well as those made apparent from the foregoing description, are efficiently attained. While preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What I claim is:

1. A combination golf club and ball carrying case comprising:

an elongated case formed by a rigid tubular housing defining a compartment;

a cover cap affixed to the upper end of said tubular housing; a base cap affixed to the lower end of said tubular housing;

a plurality of elongated tube members mounted in said cover cap, whereby said tube members are positioned within said compartment of said housing so as to support a given number of golf clubs in an upright position therein;

means attached to said rigid tubular housing to removably hold a plurality of golf balls, wherein said ball holding means comprises a resilient clamp member having extended side members converging so as to provide a grasping action around the golf balls positioned therein; and means for carrying said carrying case;

means for supporting said carrying case in an upright position when said case is not being carried, wherein said carrying-case support means comprises a spike member mounted to the bottom of said base cap member;

means for removable supporting a plurality of tees wherein said means for removably supporting a plurality of tees comprises ear members integrally formed about said cover cap member and each ear member includes a mounting hole therein to receive a tee.

2. A combination as recited in claim 1, including a clip means mounted on said housing thereof.

3. A combination as recited in claim 2, wherein said carrying means comprises a handle mounted to said housing of said carrying case.

4. A combination as recited in claim 3, wherein a cushion member is positioned within said base cap.

* * * * *